US008272169B2

(12) United States Patent
Mahdi

(10) Patent No.: US 8,272,169 B2
(45) Date of Patent: Sep. 25, 2012

(54) LOCKING DEVICE

(75) Inventor: Fouad Mahdi, Bonaduz (CH)

(73) Assignee: Pilz Auslandsbetbiligungen GmbH, Ostfildern (DE)

( * ) Notice: Subject to any disclaimer, the term of this patent is extended or adjusted under 35 U.S.C. 154(b) by 212 days.

(21) Appl. No.: 12/688,149

(22) Filed: Jan. 15, 2010

(65) Prior Publication Data

US 2010/0180511 A1 Jul. 22, 2010

(30) Foreign Application Priority Data

Jan. 22, 2009 (CH) ..... 99/09

(51) Int. Cl.
*E06B 3/70* (2006.01)

(52) U.S. Cl. ..... 49/449; 292/137; 292/143

(58) Field of Classification Search ..... 49/449, 49/394; 70/83, 130, 125–127; 292/137, 292/143, 145–147, 150, 151, 191
See application file for complete search history.

(56) References Cited

U.S. PATENT DOCUMENTS

| | | | | | |
|---|---|---|---|---|---|
| 2,062,176 | A | * | 11/1936 | Hennigan | 292/64 |
| 2,169,743 | A | * | 8/1939 | Schlage | 292/145 |
| 2,198,952 | A | * | 4/1940 | Sitko | 292/169.21 |
| 2,231,414 | A | * | 2/1941 | Model | 292/341.18 |
| 2,405,240 | A | * | 8/1946 | Shearer et al. | 70/100 |
| 2,722,819 | A | * | 11/1955 | Holmsten | 70/129 |
| 3,322,451 | A | * | 5/1967 | Bredemus | 292/137 |
| 4,480,862 | A | * | 11/1984 | Fleming | 292/162 |
| 4,687,239 | A | * | 8/1987 | Lin | 292/172 |
| 4,784,415 | A | * | 11/1988 | Malaval | 292/144 |
| 4,844,522 | A | * | 7/1989 | Pechar | 292/169 |
| 4,852,918 | A | * | 8/1989 | Allen | 292/169 |
| 5,046,771 | A | * | 9/1991 | Dedrich | 292/336.3 |
| 5,352,001 | A | | 10/1994 | Shieh | |
| 5,452,544 | A | * | 9/1995 | Weathington, Sr. | 49/394 |
| 6,092,846 | A | * | 7/2000 | Fuss et al. | 292/302 |
| 6,304,177 | B1 | * | 10/2001 | Nigro et al. | 340/542 |
| 6,409,232 | B1 | * | 6/2002 | Nigro et al. | 292/92 |
| 7,377,076 | B2 | * | 5/2008 | Shedd | 49/449 |
| 7,377,558 | B2 | * | 5/2008 | Schimmler | 292/137 |
| 7,967,348 | B2 | * | 6/2011 | Eisenhower et al. | 292/341.18 |
| 2007/0194576 | A1 | * | 8/2007 | Esposito et al. | 292/143 |
| 2009/0095037 | A1 | * | 4/2009 | Eisenhower et al. | 70/277 |

FOREIGN PATENT DOCUMENTS

| | | |
|---|---|---|
| DE | 27 36 029 | 10/1978 |
| GB | 05169 | 0/1915 |

* cited by examiner

*Primary Examiner* — Katherine W Mitchell
*Assistant Examiner* — Justin Rephann
(74) *Attorney, Agent, or Firm* — Morriss O'Bryant Compagni, PC

(57) ABSTRACT

The invention relates to a locking device (11) with a bolt part (13) and a lock part (15) for arrangement on a room-closing element having an opening and a door (17) closing the opening. The bolt part (13) has a longitudinal guiding device (25) and a bolt (23) that can be displaced in a longitudinal displacement direction (21) with respect to the longitudinal guiding device (25). The lock part (15) has a receiving opening (29) for receiving a first end of the bolt (23). The bolt part (13) has in addition to the longitudinal guiding device (25) a transverse guiding device. Spring means (39), which are in active engagement with the longitudinal guiding device (25) and the transverse guiding device cushion a displacement of the bolt (23) in a transverse adjustment direction (47). The adjustment direction (47) is directed transversely to the displacement direction (21) of the bolt (23) and parallel to the door plane and is defined by the transverse guiding device (34).

18 Claims, 7 Drawing Sheets

LOCKING DEVICE

CROSS-REFERENCE TO RELATED APPLICATIONS

This application claims priority to CH 00099/09 filed on Jan. 22, 2009, with the Swiss Federal Institute of Intellectual Property, the entirety of which is incorporated by this reference.

BACKGROUND OF THE INVENTION

1. Field of the Invention

The invention relates to a locking device with a bolt part and a lock part for arrangement on a room-closing element having an opening and a door closing the opening, which bolt part has a longitudinal guiding device and a bolt) that can be displaced in a longitudinal displacement direction with respect to the longitudinal guiding device, and which lock part has a receiving opening for receiving a first end of the bolt as well as a room-closing element with a locking device of this type having an opening with a door closing the opening.

2. State of the Art

Doors and gates are often closed by means of lock and bolt systems. In particular heavy doors and gates tend not to engage in a precisely fitting manner in the door frame or gate frame or tend to deviate from their original accurate fit with progressive use. The result of such inaccuracies in the fit between door and frame is also that doors and gates with a lock and bolt system can no longer be closed; the bolt can no longer be pressed into the lock, since the lock and bolt are displaced with respect to one another. A simple structural measure to compensate for this inaccurate fitting is to widen the bolt receiver of the lock and consequently to enlarge the clearance of the bolt in the lock. One disadvantage of the simple adjustment measure is that an electrical monitoring of the locked state is hard to realize.

In GB 05169 a bolt is arranged on a plate in a slidable manner. The plate is fixed, for example, to a door leaf. In the closed state, the bolt is accommodated in a bushing. The bushing is fixed by means of a holder plate, for example, to a door post. The bushing is accommodated on the holder plate in a slidable manner transverse to the displacement direction of the bolt. To adjust and fix the bushing in a position in which the bushing and the bolt are aligned, a trimming screw is provided. The screw is likewise arranged on the holder plate and displaces the bushing during its rotation in or counter to the clockwise direction relative to the holder plate. Although the slidable bushing is embodied in a very simple manner and compensates for distance deviations between the bolt and the bushing, the trimming screw represents an exposed part that is easily damaged. Also an electrical monitoring of the locked state, which could be provided on the bushing, can be realized only with large expenditure.

U.S. Pat. No. 5,352,001 likewise discloses a slidable bolt that engages in a bolt receiver. The bolt receiver comprises a longitudinal slot and a sleeve, which is provided in the longitudinal slot. The sleeve can be displaced along the longitudinal slot by means of a trimming screw. A position of the sleeve is thus adjustable by rotating the trimming screw in the longitudinal slot in which the bolt aligns with the sleeve. The bolt receiver is complex in construction and additionally has the disadvantages already referenced above.

DE 27 36 029 shows a device for locking and unlocking two elements that can be offset with respect to one another. The device comprises a longitudinally displaceable full coupling organ, which is accommodated in a hollow coupling organ in the locked state of the elements that can be offset to one another. The hollow coupling organ is accommodated in a bearing block in a moveable manner transversely to the locking direction. The bearing block is fixedly connected to one of the two displaceable elements. The hollow coupling organ can be blocked with respect to the bearing block. This is carried out, for example, through hydraulic cylinders or through coil springs, which press the hollow coupling organ onto the bearing block. The device is provided for special applications with high stresses, such as on ships, and embodied in a correspondingly complex manner. An electrical monitoring of the locked state, which could be provided on the hollow coupling organ, can be implemented only with great expenditure.

An advantage of the present invention is therefore to create a lock and bolt system that does not have the disadvantage listed above. Another advantage is to show ways and means that make it possible for the proposed lock and bolt system to be attached in a tamper-proof manner to all commercially available frames and doors or construction profiles. Another advantage is to show a lock and bolt system that can be equipped very easily with a system monitoring the locked state.

SUMMARY OF THE INVENTION

According to the invention, the advantages attained by a locking device with a bolt part and a lock part for arrangement on a room-closing element having an opening and a door closing the opening. The bolt part has a longitudinal guiding device and a bolt that can be displaced in a longitudinal displacement direction with respect to the longitudinal guiding device. The lock part has a receiving opening for receiving a first end of the bolt. A transverse guiding device, which has the bolt part in addition to the longitudinal guiding device and a spring means, is in active engagement with the longitudinal guiding device and the transverse guiding device and cushion a displacement of the bolt in a transverse adjustment direction. The adjustment direction is in a directed transverse to the displacement direction of the bolt and parallel to the door plane. The transverse adjustment direction is defined by the transverse guiding device.

The locking device has in a known manner a bolt part and a lock part for arrangement on a room-closing element having an opening and a door closing the opening. The bolt part has in a likewise known manner a bolt holder and a bolt that can be displaced in a displacement direction with respect to the bolt holder. The lock part has in a known manner a receiving opening for accommodating a first end of the bolt. With this locking device, according to the invention a transverse guiding device, which has the bolt part in addition to the longitudinal guiding device, and spring means, which are in active engagement with the longitudinal guiding device and the transverse guiding device and cushion a displacement of the bolt in a transverse adjustment direction, are present. The adjustment direction is advantageously directed transversely to the displacement direction of the bolt and parallel to the door plane. The transverse adjustment direction is defined by the transverse guiding device. The spring means hold the bolt part or the bolt in a central base position with respect to the transverse adjustment direction. It is thus particularly easy to transfer the bolt part into an aligned position relative to the lock part. This is of particular advantage when the locking device is attached such that the weight of the bolt part or the lock part is held by the spring means. Another advantage of the locking unit according to the invention is that the longitudinal guiding device and the transverse guiding device are provided on the bolt part. The lock part is embodied in a fixed manner. Electrical or electronic monitoring of the locked state can therefore be provided on the lock part without expenditure. Inaccurate fits between the receiving opening and the bolt, which occur during the assembly or by warpage of the doors during the use of the locking device, can be compensated by the transverse guiding device. This is of particular advantage when the clearance between the bolt and the receiving opening of the lock part has to be embodied to be particularly small for reasons of applications engineering.

In an exemplary embodiment, the transverse guiding device is guided on the longitudinal guiding device. This renders possible easy access to the spring means. The locking unit according to this exemplary embodiment can be quickly assembled. Furthermore, the spring means preload can be adjusted very easily due to the open construction method.

In another exemplary embodiment the longitudinal guiding device is guided in the transverse guiding device. This embodiment requires a small number of component parts and accordingly can be produced a low cost.

Advantageously, the guiding device is composed of at least one sliding member and a guide rail that interacts with the sliding member. This simple and at the same time cost-effective guiding device has the advantage that the bolt, embodied as the sliding member of the guide rail, or the entire bolt part provided with a sliding member or a guide rail, and/or the receiving opening, embodied as a sliding member of the guide rail, or the entire lock part, provided with a sliding body or a guide rail, are guided reliably and without jamming. The bolt part or the lock part can also be embodied as a sliding member of the guide rail.

Another advantage of this guiding device is that the locking device can be embodied such that the guide rail can be attached on the bolt part and/or on the lock part or in a fixed manner. The at least one sliding member can accordingly either be mounted in a fixed manner on the door or on the room-closing element or on the bolt part. This plurality of embodiment variants provides diverse installation options on virtually all doors, gates and room-closing elements available on the market.

According to another embodiment, means for fixing the lock part and/or bolt part with respect to the adjustment direction are provided. This embodiment has the advantage that an adjustment of the bolt part or lock part, once selected, can be retained. An adjustment during each locking operation can be omitted although a further necessary adjustment can be carried out at any time.

Advantageously, the clearance between the receiving opening and the bolt is no more than 2 mm, and may be approximately 1 mm or more precisely 0.8 mm. Due to the implementation of these small gap dimensions, the locking device according to the invention is particularly suitable for monitoring applications. It is the small gap dimensions that make it possible to arrange an electric or electronic switching unit, necessary for monitoring applications, on the lock part or bolt part.

Advantageously, the first end of the bolt and the receiving opening respectively have a chamfer on their side oriented towards the bolt. The chamfers are in active engagement with one another such that the bolt is inserted into the receiving opening during a closing operation.

In one embodiment variant, an electric or electronic switching unit of an electric or electronic alarm device is arranged on the lock part or the bolt part. This has the advantage that a reliable remote monitoring of the locking state of the locking device According to a further embodiment, the at least one sliding member is accommodated in a groove of a construction profile. The main advantage of this embodiment is that the locking device can be integrated in construction profiles. This is important when the use of profiles of this type is essential for structural reasons or when the locking device is retrofitted on construction profiles.

The subject matter of the present invention also includes a room-closing element having an opening with a door closing this opening and a locking device according to the invention, wherein the guide rail is arranged on the door. The use of the locking device has the advantage that the locking state of doors can be monitored in a cost-effective manner and the retrofitting of the locking device can also be realized particularly easily.

BRIEF DESCRIPTION OF THE DRAWINGS

The invention is described in more detail below with reference to the figures in a diagrammatic representation. They show.

DETAILED DESCRIPTION OF THE ILLUSTRATED EMBODIMENTS

Figure 1:
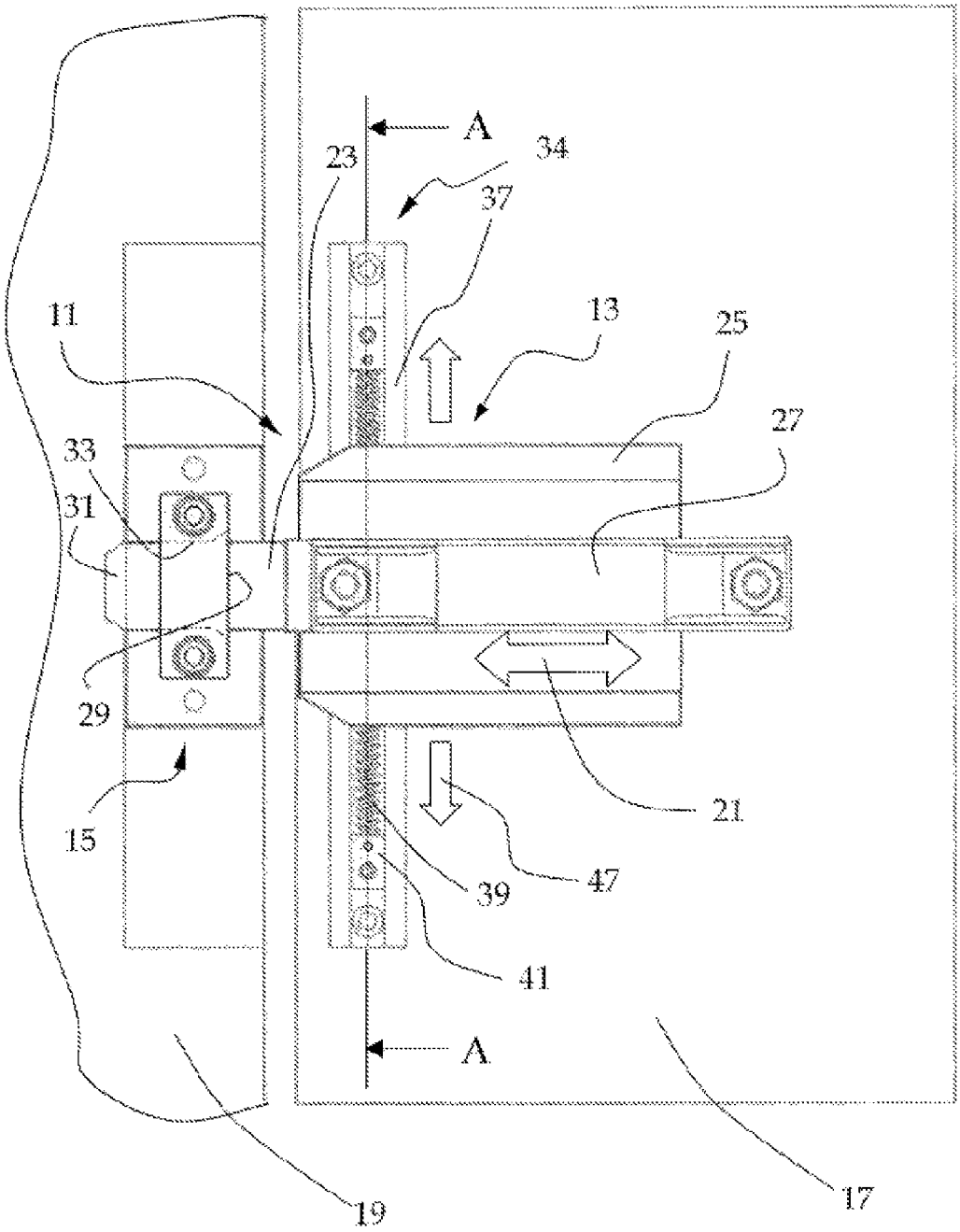
FIG. 1: Plan view of a first exemplary embodiment of the locking device.
Figure 2:
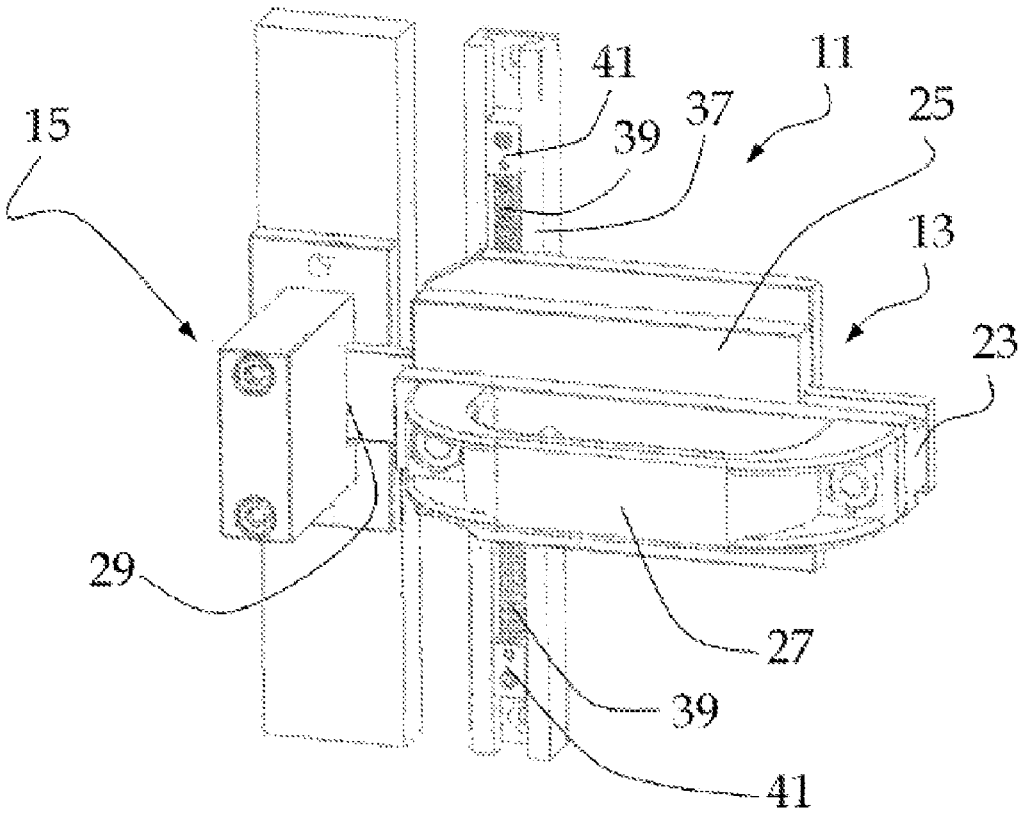
FIG. 2: The exemplary embodiment from FIG. 1 in a perspective representation.
Figure 3:
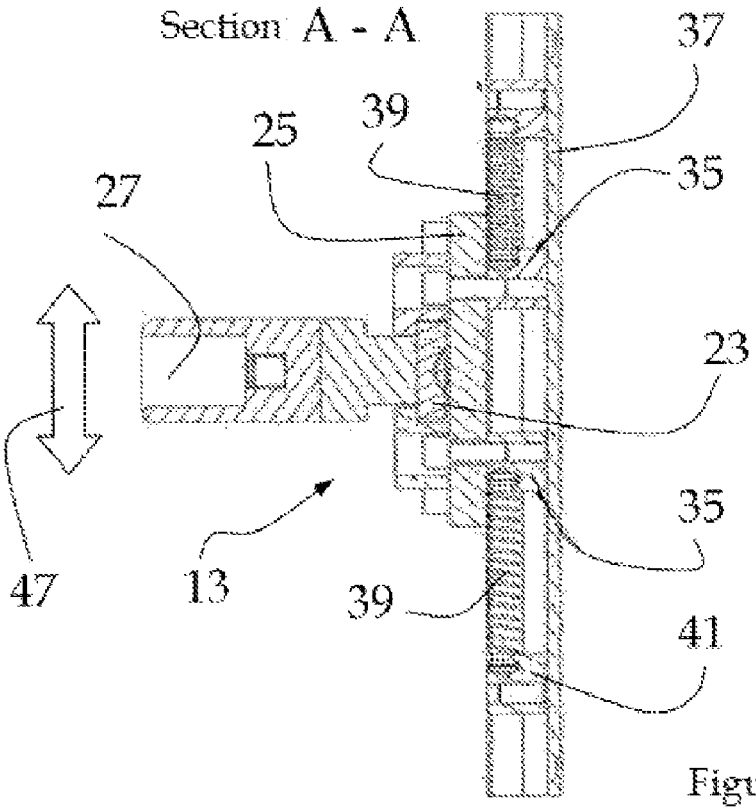
FIG. 3: A sectional view of the exemplary embodiment from FIG. 1.

FIGS. 1 through 3 show a locking device 11 with a bolt part 13 and a lock part 15. FIG. 1 shows that the bolt part 13 is attached to a door 17 and the lock part 15 is attached to a room-closing element 19. The bolt part comprises a bolt 23 that is displaceable in the longitudinal displacement direction 21. A longitudinal guiding device 25 is used as a guide for the bolt 23 and a holder in its movement along the longitudinal displacement direction 21. A handle 27 is arranged on the bolt 23. The lock part 15 has a receiving opening 29. For easier accommodation of the bolt 23 in the receptacle 29, a chamfer 31 is located on the end of the bolt 27 facing towards the receptacle device 29. The mounting opening 29 is likewise rounded by a chamfer 33. As FIG. 3 shows, the bolt part 13 has a transverse guiding device 34. The transverse guiding device 34 comprises two sliding members 35 and a guide rail 37. The two sliding members 35 are arranged on the side of the longitudinal guiding device 25 facing away from the handle 27. The bolt part 13 is rail-guided by the sliding member 35 in the guide rail 37 along a transverse adjustment direction 47. Respectively one spiral spring 39 is attached by its first end to the two sliding members 35. The two spiral springs 39 extend in the guide rail 37 and are fixed by their ends facing away from the closing part 13 to the guide rail 37 with clamping bolts 41. The closing part 13 is held centrally to the longitudinal extension of the guide rail 37 in a base position by the spiral springs. It is also conceivable that the guide rail 37 is arranged on the longitudinal guiding device 25 and the sliding members 35 are mounted fixedly on the door 17 (not shown in the Figs.).

Figure 4:
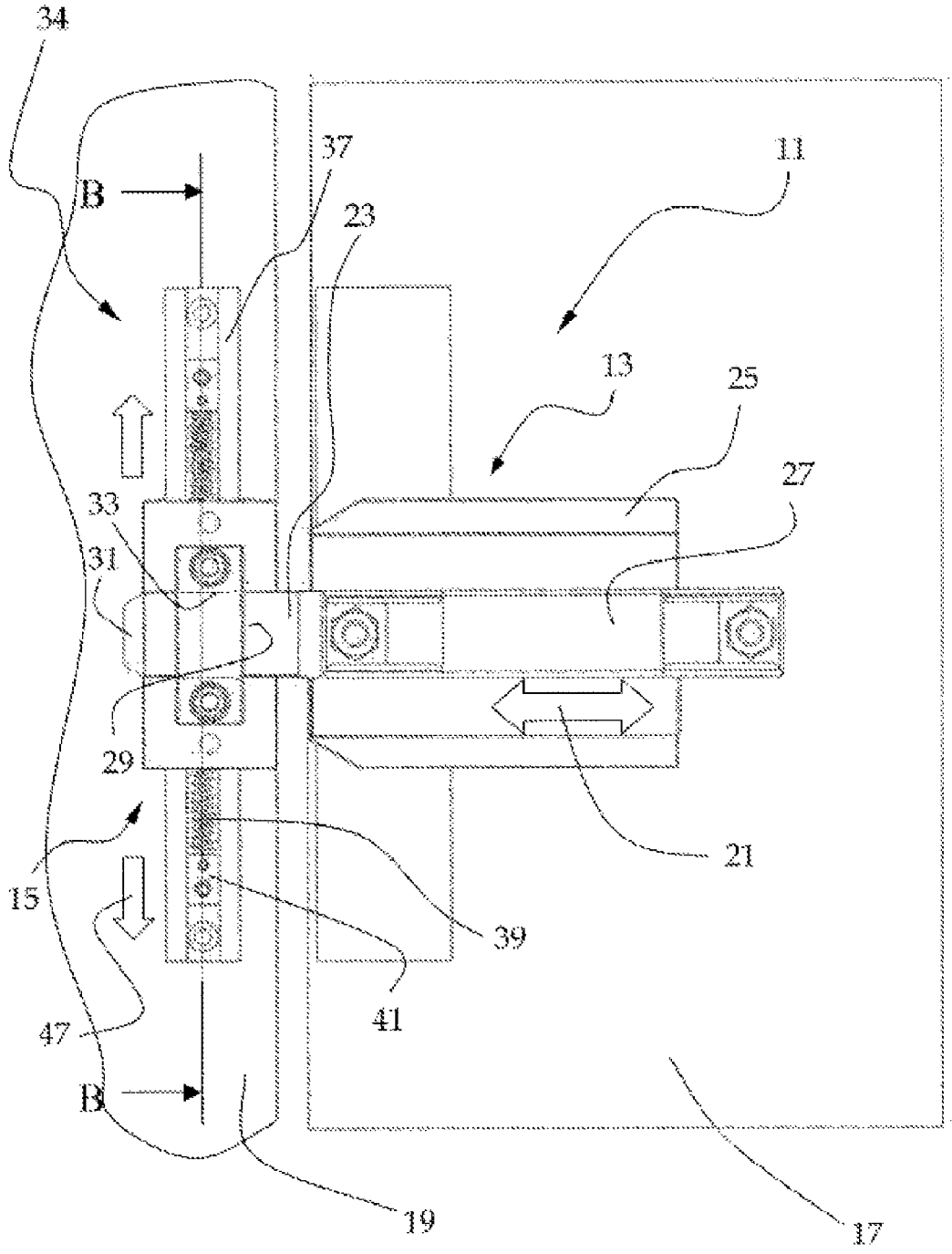
FIG. 4: A plan view of a second exemplary embodiment of the locking device.
Figure 5:
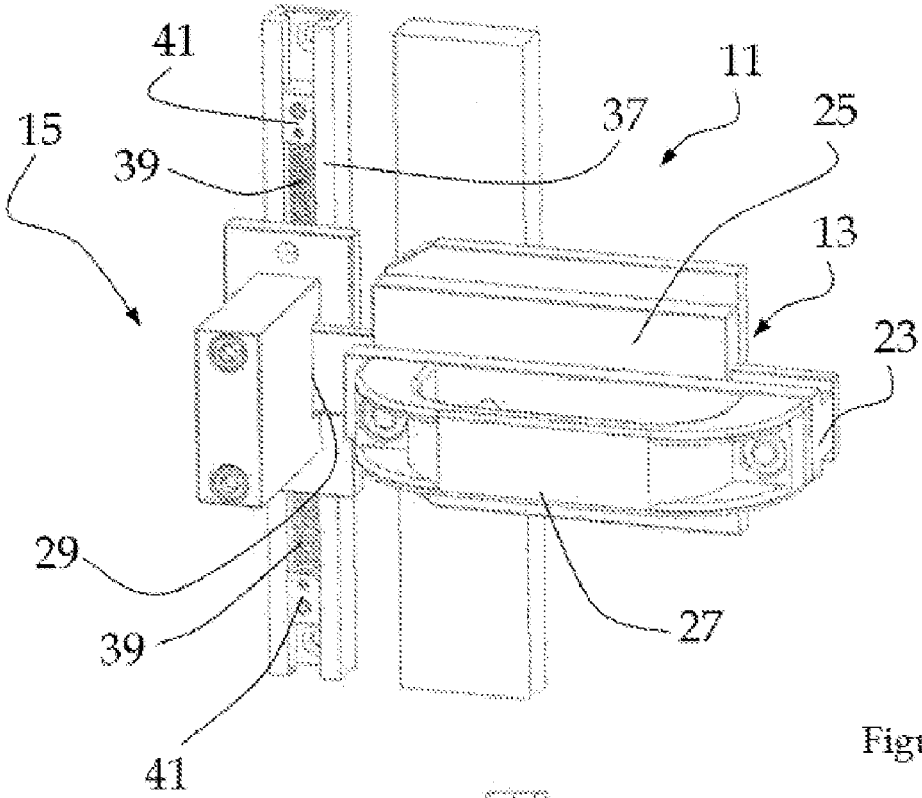
FIG. 5: The exemplary embodiment from FIG. 4 in a perspective representation.
Figure 6:
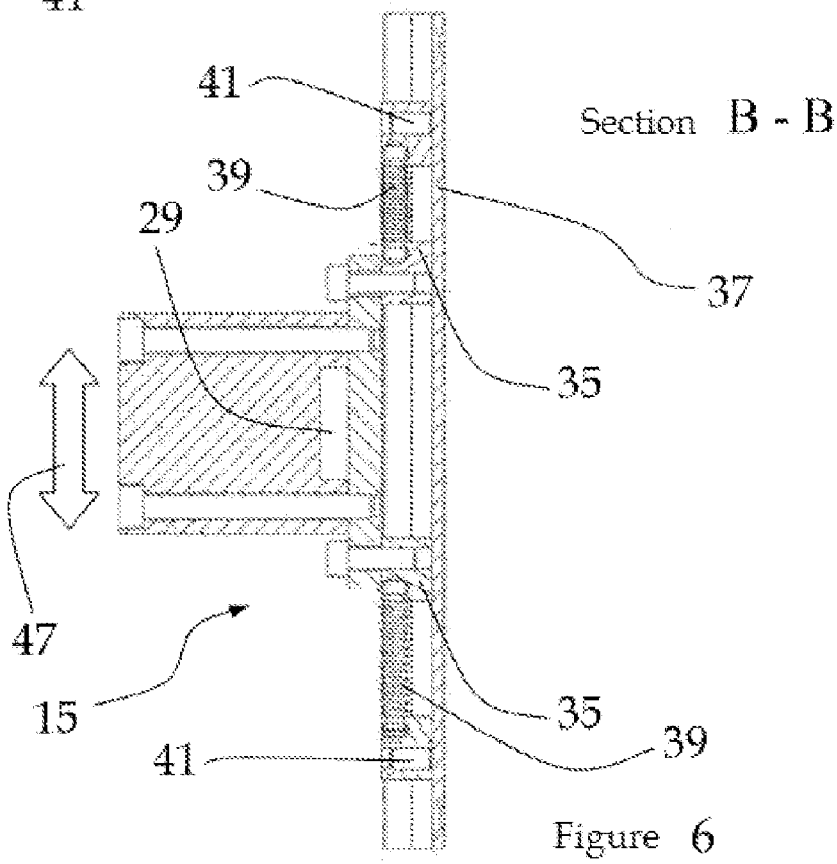
FIG. 6: A sectional representation of the exemplary embodiment from FIG. 4.

FIGS. 4 through 6 show an embodiment in which the lock part is accommodated in the guide rail in a movable manner. The guiding device shown is identical to the guiding device of the exemplary embodiment from FIGS. 1 through 3, with the difference that the two sliding members 35 are arranged on the lock part 15. Another embodiment is produced in that the guide rail 37 is arranged on the longitudinal guiding device 25 and the sliding members 35 are mounted in a fixed manner on the room-closing element 19 (not shown in the Figs.).

Figure 7:
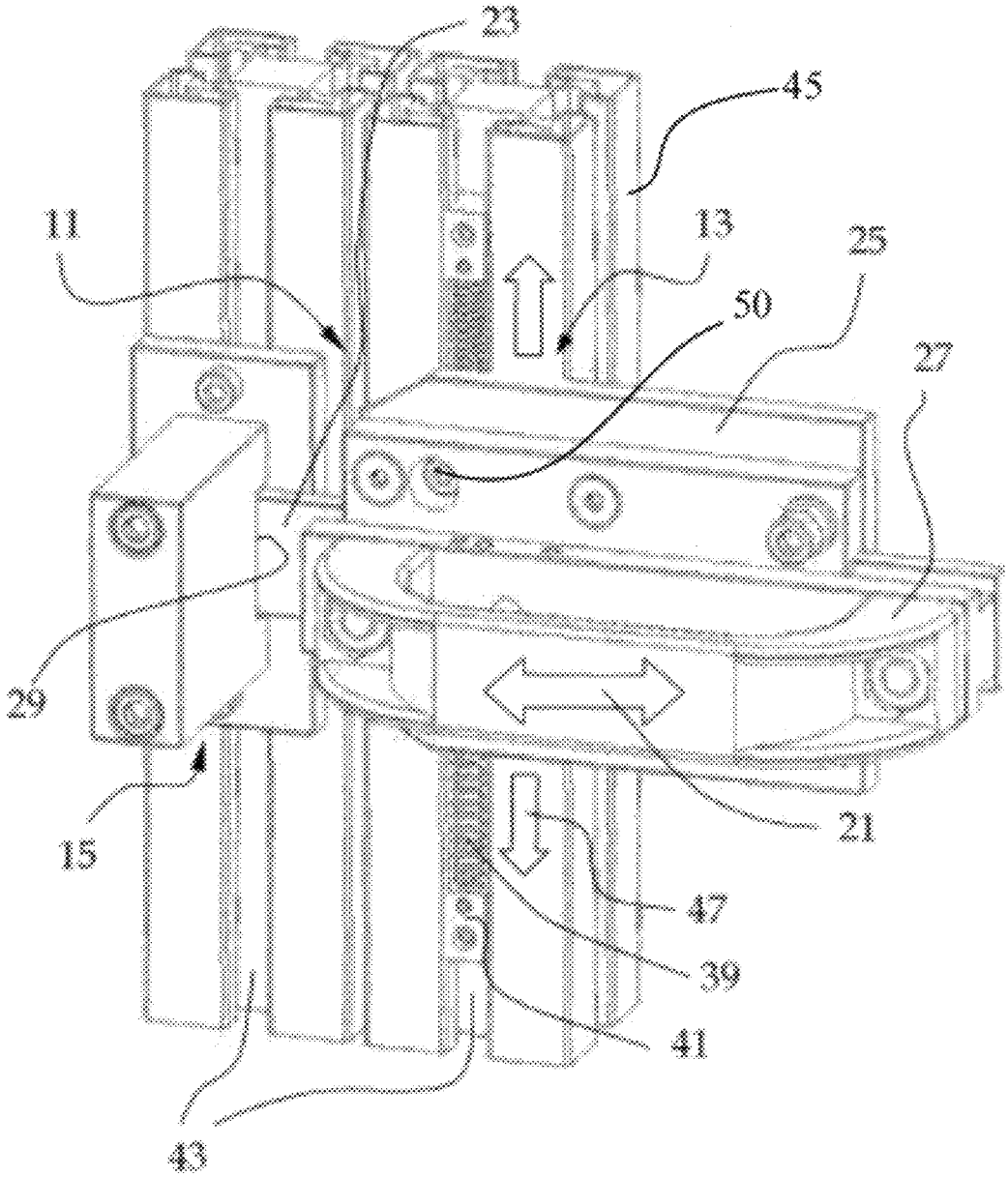
FIG. 7: A third exemplary embodiment in perspective representation, wherein the locking device is arranged on commercially available construction profiles.
Figure 8:
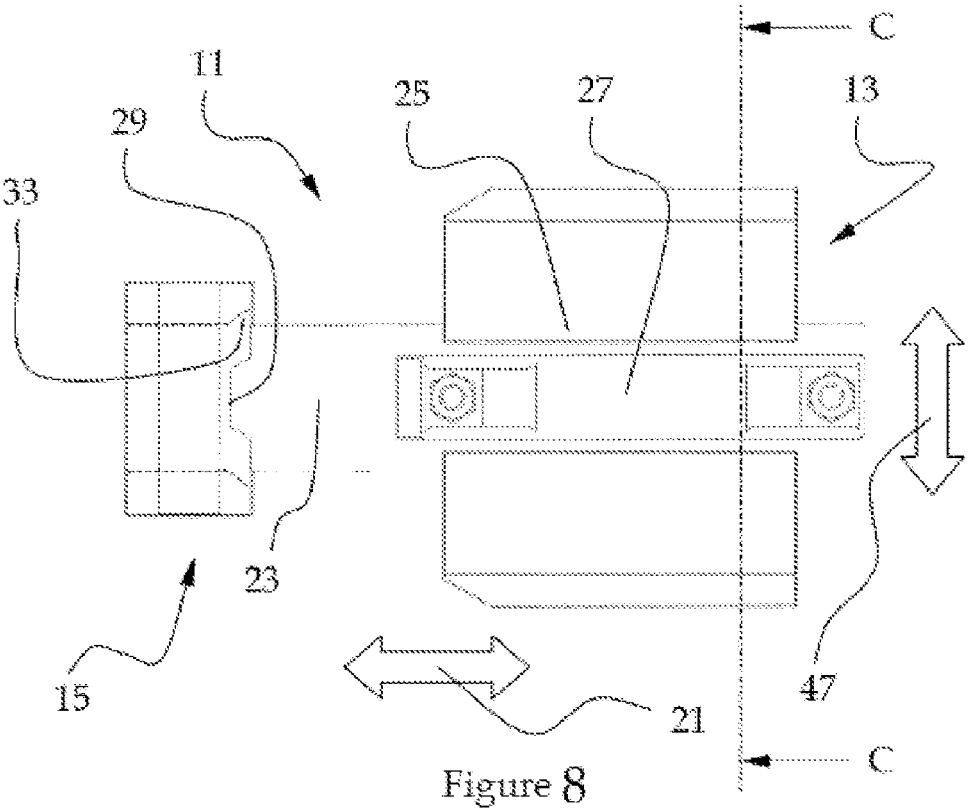
FIG. 8: A fourth exemplary embodiment in a plan view.
Figure 9:
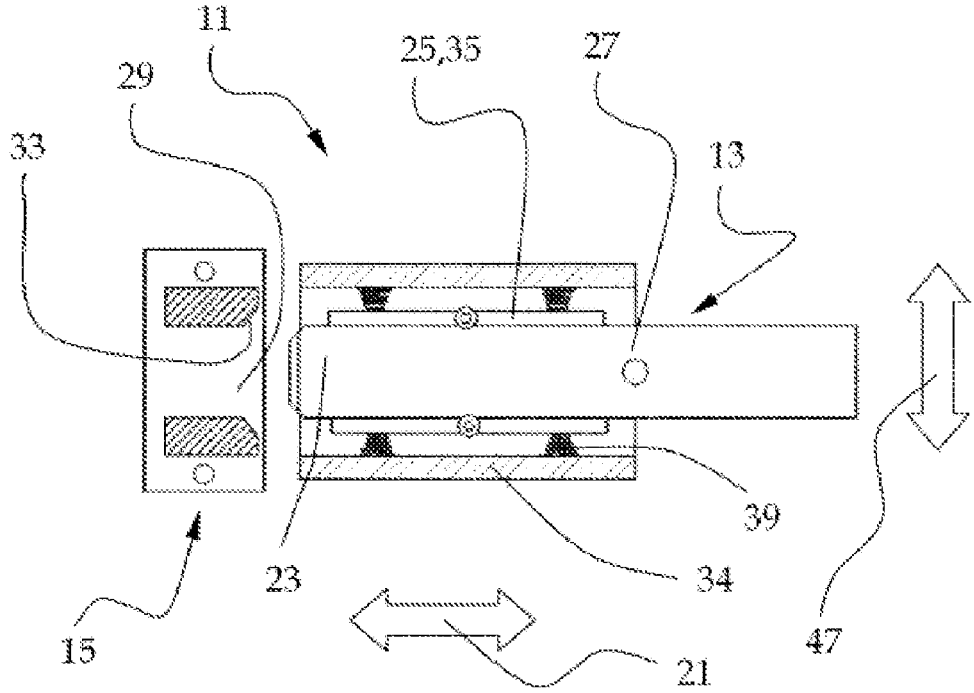
FIG. 9: A longitudinal section through the exemplary embodiment from FIG. 8.
Figure 10:
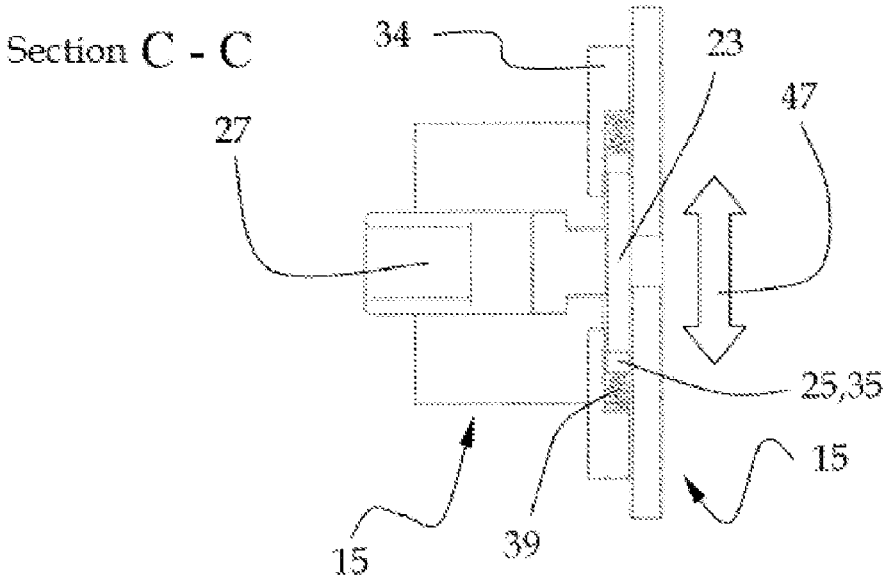
FIG. 10: A side view of the exemplary embodiment from FIG. 8.
Figure 11:
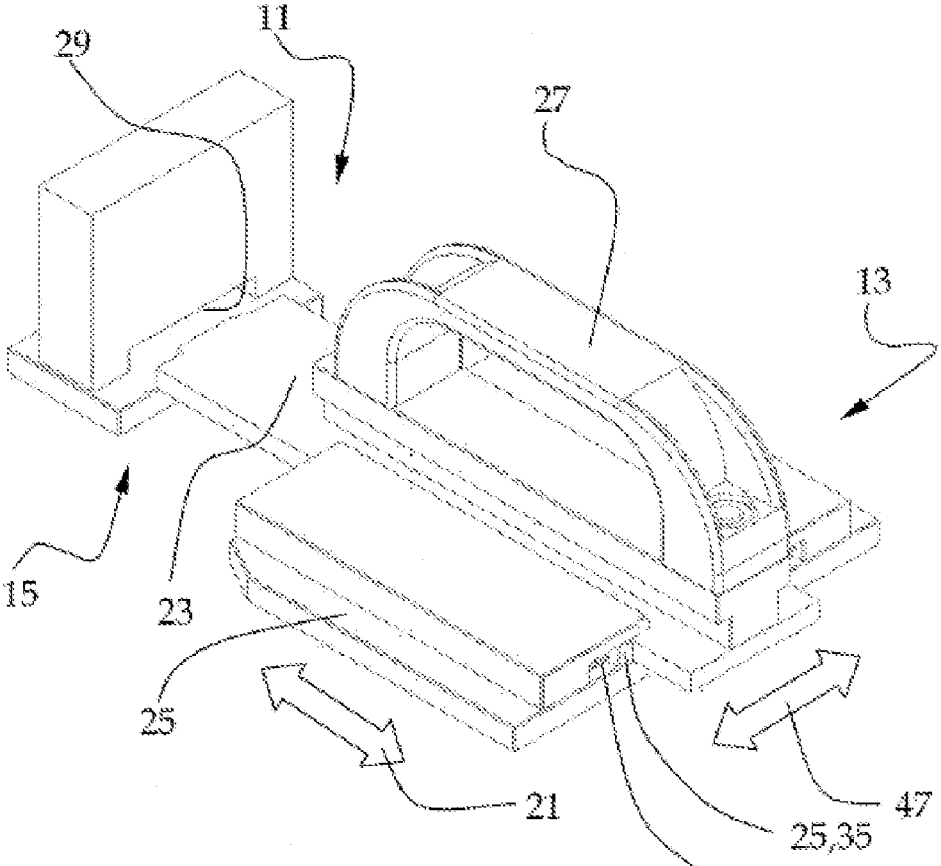
FIG. 11: The exemplary embodiment from FIG. 8 in a perspective view.

FIG. 7 shows an embodiment in which the guide rail 37 is replaced by the groove 43 of a commercially available construction profile 45. As already stated above, it is also conceivable that the sliding members 35 are arranged on the lock part 15. The sliding members 35 can then likewise be accommodated in the groove 43 of a construction profile 45.

FIGS. 8 through 11 show an exemplary embodiment of the locking unit 11 in which the bolt 23 can be displaced at the same time in the longitudinal displacement direction 21 and in the transverse adjustment direction 47 in the longitudinal guiding device 25. In this exemplary embodiment, the longitudinal guiding device 25 takes over the function of the sliding members 35. The guide rail 37 is then no longer present in this embodiment of the locking device, since the longitudinal guiding unit is guided in the transverse guiding unit 34. This embodiment has a compact construction and requires fewer component parts and can be realized in a very cost-effective manner.

In order to embody the locking device 11 in a tamper-proof manner, it is advantageous after mounting to cover attaching material required, to make it permanent or to use special tamper-proof attaching material.

The locking device 11 according to the invention functions according to the exemplary embodiment shown in FIGS. 1 through 3 as follows: The door 17 is closed with the aid of the handle 27. The bolt 23 is moved along the longitudinal displacement direction 21 in the direction of the lock part 15 and abuts against the lock part 15. Subsequently the bolt part 13 is moved in the direction of the transverse adjustment direction 47 until the bolt 23 is aligned with the receiving opening 29. Subsequently, the bolt 23 is pushed into the receiving opening 29 until it touches the lock part 15 with the handle 27. Achieving alignment between the bolt 23 and the receiving opening 29 is facilitated by the interaction of the chamfers 31 and 33.

In a further embodiment variant the aligned position between the bolt 23 and the mounting opening 29 can be fixed after being adjusted once, for example, by a clamping device 50. If needed, the selected attachment of the bolt part 13 to the lock part 15 can be cancelled and readjusted at any time.

The adjustable locking device 11 is advantageous in particular when the clearance between the bolt 23 and the receiving opening 29 is 2 mm or less. Changes in the position of the door 17 relative to the frames occur, however, in particular with progressive use but also through inadequate adjustment. In the case shown of a low clearance between the bolt 23 and the receiving opening 29, door displacements of 1 mm already lead to the bolt 23 jamming in the receiving opening 29. Gap widths of no more than 2 mm between the bolt 23 and the receiving opening 29 are used in particular when the locking device 11 is monitored electronically or electrically with an alarm. The electric or electronic switching units used with an alarm monitoring of this type must be arranged on the bolt 23 or on the receiving opening 29. Even slight deviations in the fit tolerances between the bolt 23 and the receiving opening 29 inevitably lead to a malfunction of the referenced switching units. An exact interaction of the bolt part 13 and the lock part 15 is therefore important for a reliable function of the alarm monitoring.

The invention claimed is:

1. A locking device, comprising:

a bolt part and a lock part for arrangement on a room-closing element having an opening and a door closing the opening, the bolt part having a longitudinal guiding device and a bolt that can be displaced in a longitudinal displacement direction with respect to the longitudinal guiding device, and the lock part having a receiving opening for receiving a first end of the bolt, a transverse guiding device, having the bolt part, the longitudinal guiding device, and a spring device in active engagement with the longitudinal guiding device and the transverse guiding device to cushion a displacement of the bolt in a transverse adjustment direction, the adjustment direction being directed transversely to the displacement direction of the bolt and parallel to a door plane and being defined by the transverse guiding device, and structure for fixing the bolt part with respect to the transverse adjustment direction.

2. The locking device according to claim 1, wherein the transverse guiding device is guided on the longitudinal guiding device.

3. The locking device according to claim 1, wherein the longitudinal guiding device is guided in the transverse guiding device.

4. The locking device according to claim 1, wherein the transverse guiding device is comprised of at least one sliding member and a guide rail that interacts with the sliding member.

5. The locking device according to claim 4, wherein the at least one sliding member is arranged on the longitudinal guiding device and the guide rail is provided for fixed attachment to a substrate.

6. The locking device according to claim 4, wherein the guide rail is arranged on the longitudinal guiding device and the at least one fixed sliding member is provided for fixed attachment to a substrate.

7. The locking device according to claim 1, wherein a clearance between the receiving opening and the bolt is no more than 2 mm.

8. The locking device according to claim 1, wherein the first end of the bolt has a chamfer.

9. The locking device according to claim 1, wherein the receiving opening has a chamfer on its side oriented towards the bolt.

10. The locking device according to claim 1, wherein the at least one sliding member is accommodated in a groove of a construction profile.

11. A locking device, comprising:

a lock assembly defining a receiving opening configured for securing to a stationary structure;

a bolt assembly configured for securing to a door adjacent the stationary structure, the bolt assembly comprising:

a vertical guide assembly;

a longitudinal guiding device defining a longitudinally extending channel coupled and transversely biased relative to the vertical guide assembly to the to allow limited, biased vertical movement of the guiding device relative to the vertical guide assembly;

a bolt vertically and horizontally retained within the longitudinal guiding device and being freely displaceable in a longitudinal direction within the longitudinal guiding device between a first position in which the bolt is disengaged from the lock assembly and a second position in which the bolt is inserted into the receiving opening and engages the lock assembly and wherein the bolt is adjustable between a first vertical position and a second vertical position according to the limited, biased vertical movement of the guiding device relative to the vertical guide assembly allowing the bolt to be aligned with and at least partially inserted into the receiving opening of the locking assembly.

12. The locking device of claim 11, wherein the longitudinal guiding device is movable relative to the vertical guide assembly between a first vertical position in which the bolt is vertically positioned at least partially above the receiving opening and a second vertical position in which the bolt is vertically positioned at least partially below the receiving opening.

13. The locking device of claim 12, wherein the vertical guide assembly prevents longitudinal and horizontal movement of the longitudinal guiding assembly relative to the vertical guide assembly.

14. The locking device of claim 11, wherein the bolt is comprised of an elongate planar portion slidable within the longitudinal guiding device and wherein the longitudinally extending channel of the longitudinal guiding device includes first and second longitudinal portions that extend over the elongate planar portion for retaining the elongate planar portion within the longitudinal guiding device.

15. The locking device of claim 14, further comprising a handle attached to the bolt and extending between the first and second longitudinal portions, the handle configured for grasping by a user to slide the bolt between the first position and the second position.

16. The locking device of claim 11, wherein a first end of the bolt has a first pair of chamfers, one on each of a first and second side thereof for engaging with a second pair of chamfers provided inside surfaces of the lock assembly for engaging with at least one of the first pair of chamfers for guiding the first end of the bolt into the receiving opening of the lock assembly.

17. The locking device of claim 11, further comprising a plurality of springs interposed between the vertical guide assembly and the longitudinal guiding device for biasing the longitudinal guiding device relative to the vertical guide assembly.

18. The locking device of claim 17, wherein the plurality of springs comprise at least one spring disposed above the longitudinal guiding device and at least one spring disposed below the longitudinal guiding device.

* * * * *